US005451092A

United States Patent [19]

Gray

[11] Patent Number: 5,451,092

[45] Date of Patent: Sep. 19, 1995

[54] COMBINATION CHAISE LOUNGE AND MASSAGE TABLE

[76] Inventor: Arnold L. Gray, 307 Ancolote Rd., Tarpon Springs, Fla. 34689

[21] Appl. No.: 183,387

[22] Filed: Jan. 19, 1994

[51] Int. Cl.[6] ..... A47B 85/04

[52] U.S. Cl. ..... 297/122; 297/162; 297/188.13; 297/217.1; 297/411.29; 297/440.1; 297/377; 297/463.1; 297/466; 482/130

[58] Field of Search ..... 297/112, 115, 119, 122–124, 297/135, 148, 153, 160, 162, 354.13, 411.2, 411.29, 423.1, 183.1, 188.01, 188.04, 188.08, 188.09, 188.11, 188.13, 217.1, 423.38, 440.1, 440.14, 440.24, 377, 423.4, 463.1, 466; 482/130, 123, 129, 133, 142

[56] References Cited

U.S. PATENT DOCUMENTS

| | | | |
|---|---|---|---|
| 3,136,578 | 6/1964 | Tihovici | 297/188.19 X |
| 3,707,284 | 12/1972 | Waldeck | 482/130 |
| 4,300,798 | 11/1981 | Musgrove et al. | 297/162 X |
| 4,334,710 | 6/1982 | Milner, Jr. | 297/440.12 X |
| 4,805,901 | 2/1989 | Kulick | 297/119 X |
| 4,815,732 | 3/1989 | Mahvi | 297/115 X |
| 4,913,423 | 4/1990 | Farran et al. | 482/130 |
| 4,921,247 | 5/1990 | Sterling | 482/130 X |

FOREIGN PATENT DOCUMENTS

| | | | |
|---|---|---|---|
| 153123 | 5/1951 | Australia | 297/188.08 |

*Primary Examiner*—Kenneth J. Dorner
*Assistant Examiner*—Milton Nelson, Jr.
*Attorney, Agent, or Firm*—Joseph C. Mason, Jr.; Ronald E. Smith

[57] ABSTRACT

A combination chaise lounge and massage table is easily and quickly convertible from one configuration into the other. A hollow pedestal provides the support for the lounge and the table and a storage space for the miscellaneous attachments that are used with the combination article of furniture. In the chaise lounge configuration, a plurality of elongate bias members that end in handles are removably mounted to the front end of the lounge and to the seat back so that numerous exercises may be performed. The seat and seat back of the lounge are hingedly mounted to one another and the seat back is hingedly mounted to the pedestal to enable facile positioning of the seat and seat back in a common plane. One end of the pedestal is elevated with respect to the other end so that the massage table is inclined from the horizontal to enhance its beneficial aspects.

15 Claims, 4 Drawing Sheets

COMBINATION CHAISE LOUNGE AND MASSAGE TABLE

BACKGROUND OF THE INVENTION

1. Field of the Invention

This invention relates, generally, to furniture. More particularly, it relates to a chaise lounge that is convertible into a massage table and which has receptacles for receiving exercise equipment.

2. Description of the Prior Art

Numerous chaise lounges and massage tables have been invented in the past, but the two arts have not heretofore been combined to any meaningful extent. Massage tables are large, monolithic structures having little utility beyond supporting the human body in a supine position, whereas chaise lounges have little utility beyond supporting the body in a slightly reclined position. Exercise devices, on the other hand, are usually complex items having multiple uses, and they have not heretofore been combined with chaise lounges or massage tables. Thus, the disparate arts of massage tables, chaise lounges, and exercise devices are somewhat mutually exclusive, and there have been no known developments in any of said arts that points toward their combination in the way disclosed herein.

SUMMARY OF THE INVENTION

The present invention provides a combination chaise lounge and massage table having receptacles for receiving exercise equipment having multiple attachments so that a person seated or lying thereon may exercise many different muscles. When in its massage table configuration, it is inclined relative to a horizontal plane so that the feet of a person lying thereon may be elevated with respect to his or her head, or vice versa. The conversion from the chaise lounge configuration to the massage table configuration is accomplished in just a few seconds and requires no tools.

The novel device includes a hollow pedestal that provides the support for the lounge and the massage table. The pedestal has a rectangular configuration when seen in plan view and includes a front wall, a back wall, and a pair of sidewalls disposed in interconnecting relation to opposite edges of said front and back wall. Large openings are formed in both the front and the back wall to facilitate storage of various attachments in the space defined by the four walls of the pedestal; a flexible flap covers each opening for aesthetic purposes. A pair of cuts are formed in the top edge of each sidewall; a first cut accommodates the seat part of the chaise lounge, and a second cut accommodates the back part of said lounge. Beginning at the foot end of the lounge, the first cut deepens gradually until it reaches a maximum depth near the head end of the lounge; thus, the top edges of the sidewalls are gradually inclined downwardly from the foot toward the head of the lounge. Beginning at the head end of the lounge and extending a short distance toward the foot end, the second cut is sharply downwardly inclined; it meets the head end of the first cut near the head end of the lounge. A flat seat is supported along its opposite longitudinal edges by the gradually rearwardly and downwardly inclined top edges of the pedestal sidewalls, and the lower part of a flat seat back is supported along its opposite longitudinal edges by the sharply forwardly and downwardly inclined top edges of said pedestal sidewalls.

A first hinge interconnects the seat and back parts of the lounge where they meet, and a second hinge pivotally interconnects the back of the seat back and the rear wall of the pedestal. When the seat back is rotated in a rearwardly direction, it lifts the seat until the seat back and seat are in a common plane. Since the rear wall extends a little higher than the front wall, the plane of the seat and seat back is inclined from the horizontal by a few degrees. A first rotatably mounted support post is brought into upstanding relation to support the seat so that it remains in coplanar relation to the seat back even when said seat and seat back support weight. A second pivotally mounted support post depends from the back of the seat back and is positioned by gravity into supporting relation to the seat back when the seat back is rotated rearwardly. The first and second support posts thus support the seat and seat back and maintain them in their common plane.

The exercise attachments include a plurality of elongate springs, bungee cords, or other suitable bias means that terminate in handles and which are enclosed in accordion-pleated fabric for safety purposes. A first pair of springs are releasably mounted to the pedestal at the bottom front end thereof. A third spring is releasably mounted to the underside of the seat at its forward end. Another pair of springs extend from opposite ends of a pair of removably mounted rod members that extend laterally with respect to the seat back.

The chaise lounge and table combination further includes a pair of removably mounted arm rests, a removably mounted tray that is pivotally mounted to the free end of a preselected arm rest for rotation in a horizontal plane, and a reading light removably mounted to the top edge of the seat back.

The primary object of this invention is to advance the disparate arts of chaise lounges and massage tables by combining the two arts in an elegant way to produce a combination chaise lounge and massage table.

A more specific object is to provide the aforesaid combination device in a form that is quickly and easily convertible from one mode to the other.

Another object is to provide a combination chaise lounge and massage table having receptacles for the facile mounting of multiple exercise devices that are storable within the combination article of furniture.

Another important object is to provide a massage table that is inclined from the horizontal to enhance the beneficial effects that may be achieved from reclining upon said table.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 2:
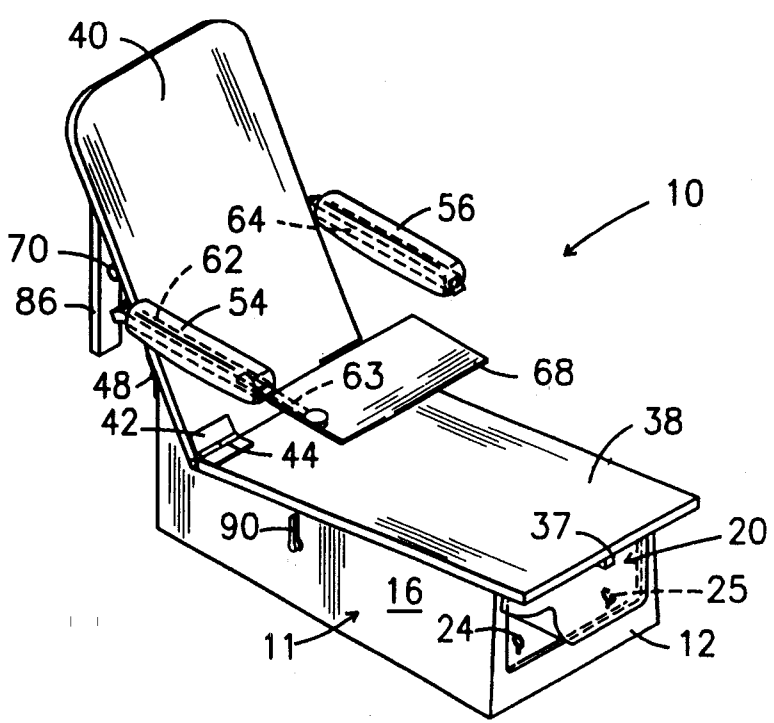
FIG. 2 is a view similar to the view of FIG. 1, but with the upholstery removed to better depict the structure of the apparatus.
Figure 1:
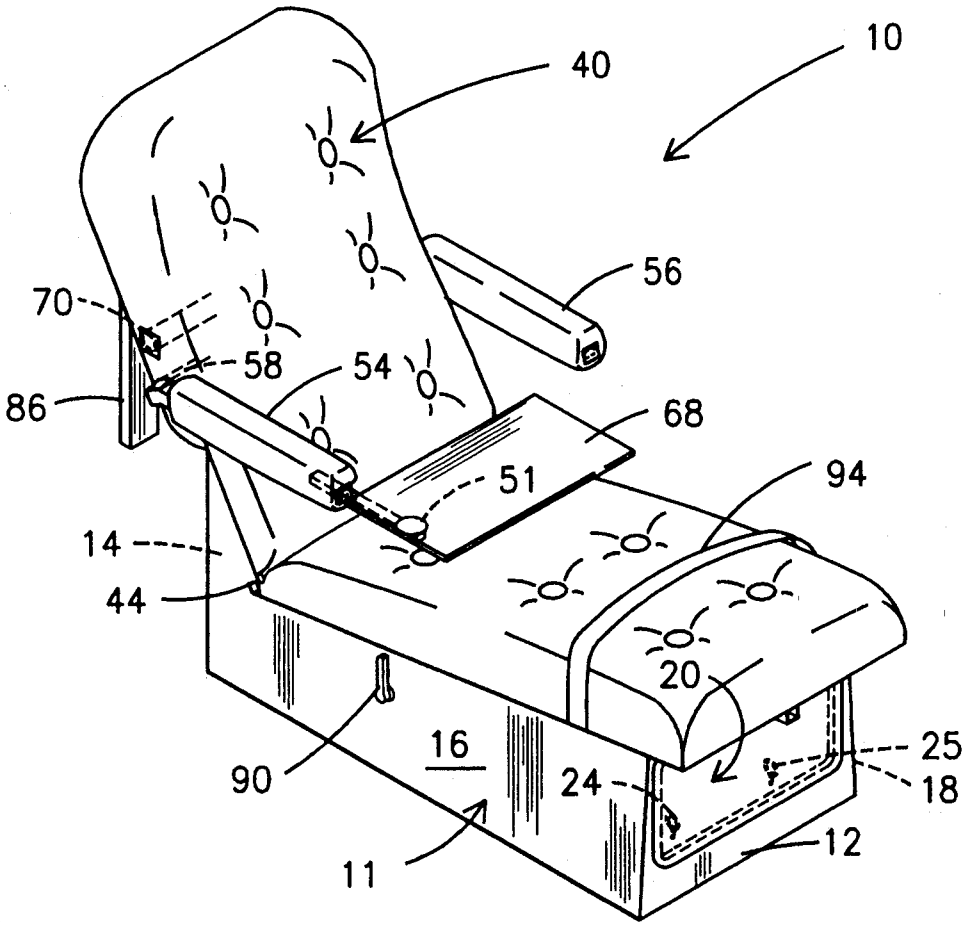
FIG. 1 is a perspective view of a commercial embodiment of the novel furniture item, depicting its appearance when covered by upholstery and when positioned in its chaise lounge or chair configuration with the exercise attachments stored out of view within the hollow pedestal.
Figure 3:
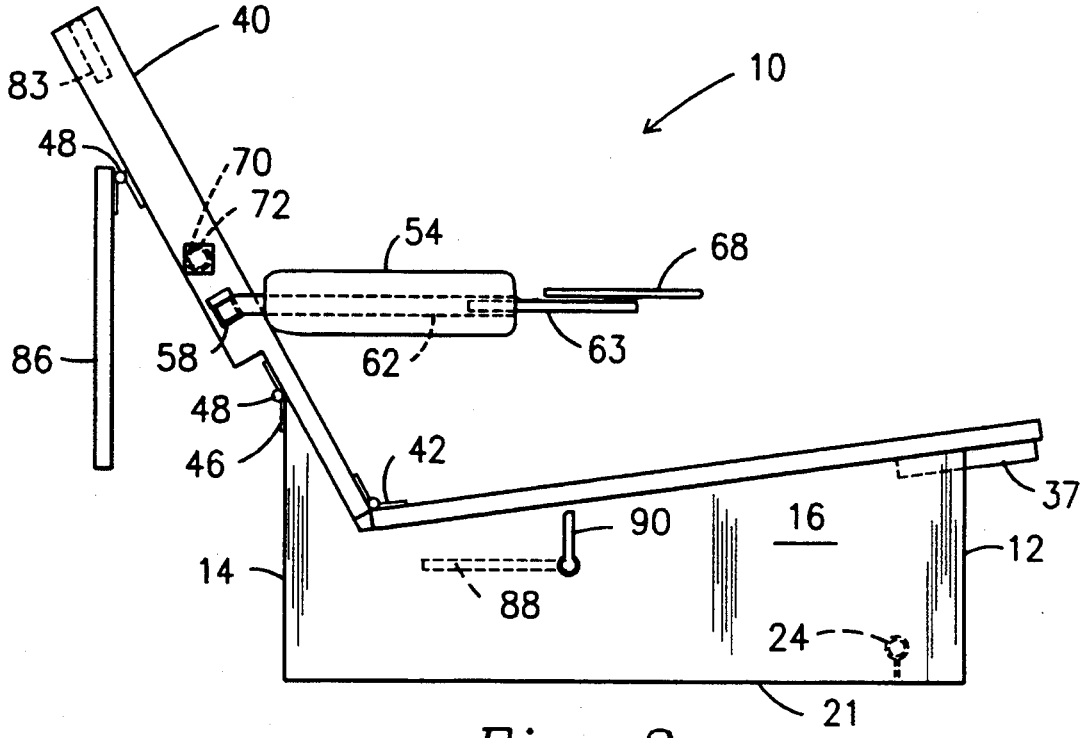
FIG. 3 is a side elevational view of the apparatus depicted in FIG. 2.
Figure 4:
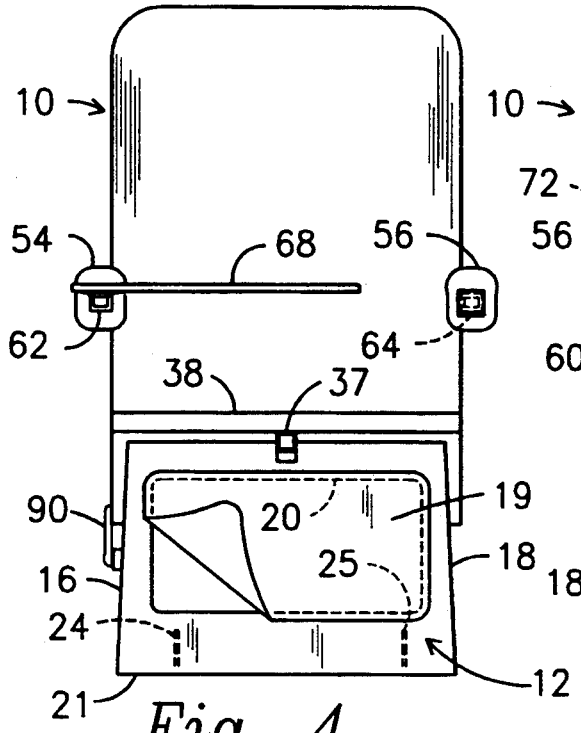
FIG. 4 is a front elevational view of the apparatus depicted in FIG. 2.
Figure 5:
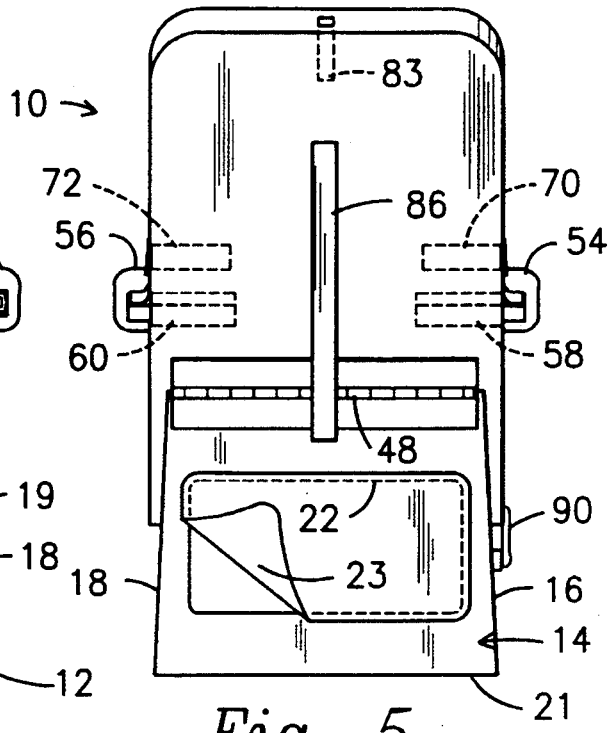
FIG. 5 is a rear elevational view of the apparatus depicted in FIG. 2.

Referring now to FIGS. 1–5, it will there be seen that an exemplary embodiment of the invention is denoted as a whole by the reference numeral 10. The contemplated commercial embodiment of the novel article of furniture will be a well-upholstered, aesthetically pleasing item that will be displayed in the home of its owner along with other items of finely appointed furniture, i.e., its multiple uses as a chaise lounge and massage table with attachments for exercise devices will not be apparent upon casual inspection. All openings for the attachment of exercise devices and for the storage of items will be artfully covered with flaps, as pointed out in detail hereinafter.

Combination article of furniture 10 includes a hollow pedestal 11 that includes an upstanding front wall 12, an upstanding rear wall 14, and upstanding sidewalls 16, 18 that interconnect said front and rear walls at their opposite edges. The sidewalls are inclined slightly toward one another as perhaps best depicted in FIGS. 4 and 5.

An access opening 20 is formed in front wall 12, a similar access opening 22 is formed in rear wall 14, and a bottom wall 21 provides a support surface for articles stored within the hollow interior of the pedestal. Access openings 20 and 22 are covered by flexible flaps 19 and 23, respectively, as best understood in connection with FIGS. 4 and 5.

Figure 7:
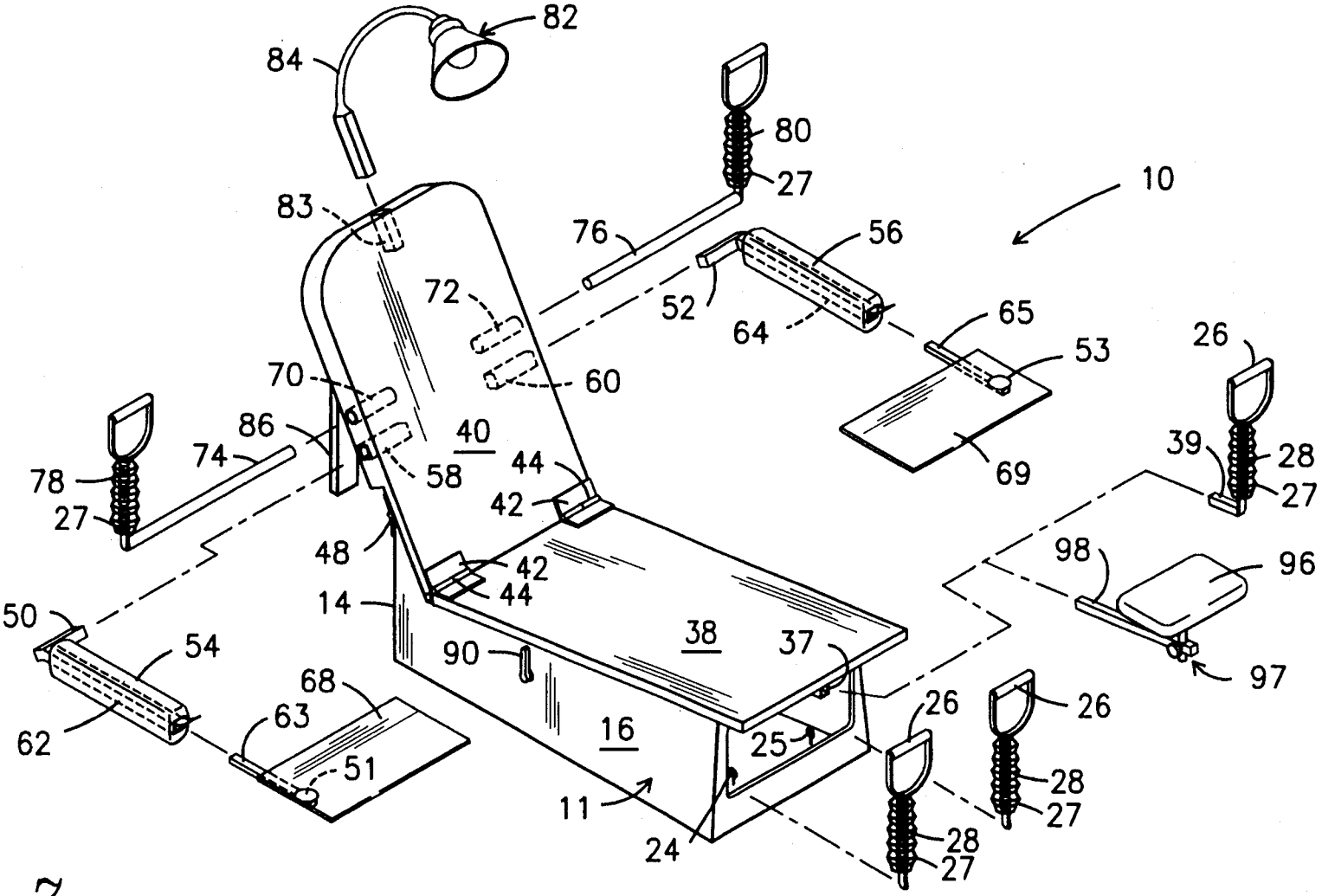
FIG. 7 is a partially exploded perspective view of the invention when in its chaise lounge configuration.

Eye hooks 24, 25 are mounted in the interior of the pedestal near the front access opening 20, on opposite sides thereof, and provide a mounting means for the releasable attachment of elongate bias means such as springs 28 or bungee cords having handles 26 at the free ends thereof; said accessories are depicted in FIG. 7. Note that accordion-pleated fabric 27 covers the springs or cords to prevent injury if a spring or cord should break. The fabric matches the fabric with which the furniture is upholstered.

Square tube 37, mounted to the bottom of seat 38 in registration with its longitudinal axis of symmetry, also provides a mount for a spring or bungee cord and handle assembly; it telescopically receives square tube 39 that forms a part of the bias means 28 and handle 26 assembly as shown; an eye hook or other suitable attachment means could take the place of square tube 37. In the contemplated commercial embodiment, square tube 37 will be covered with upholstery and will not be visible along its extent; its free end will be covered by a flexible flap as well.

Figure 6:
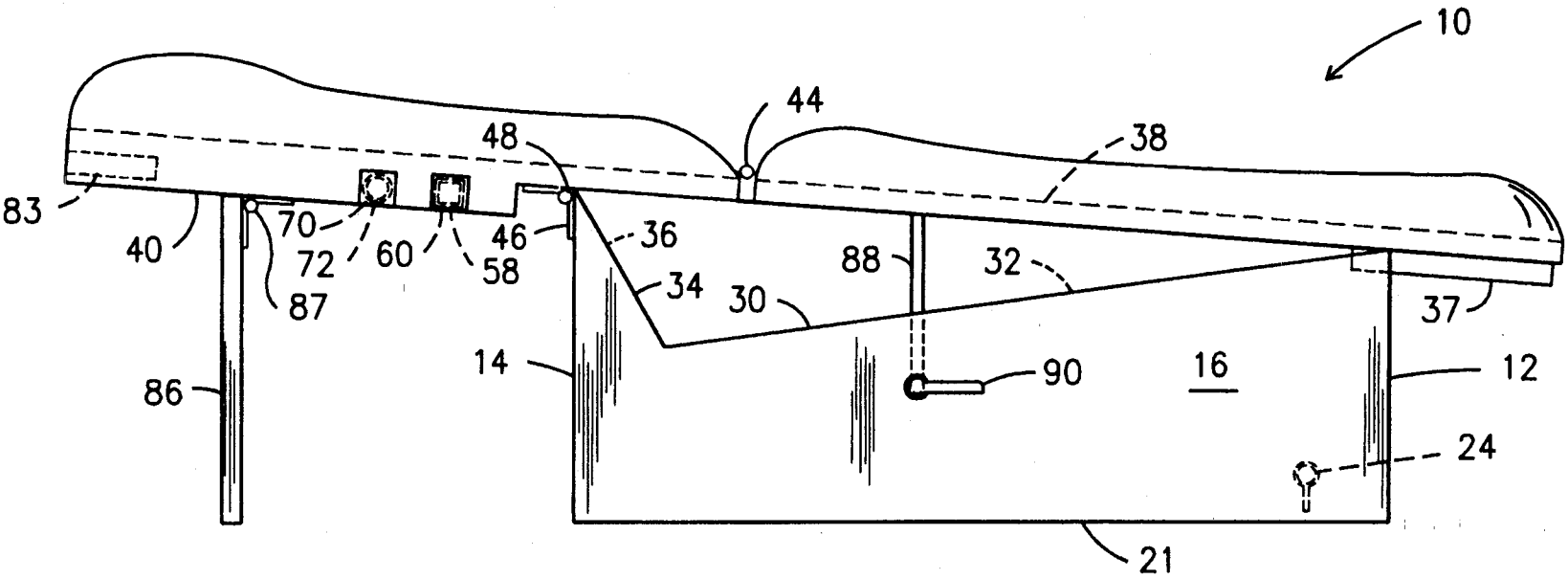
FIG. 6 is a side elevational view of the apparatus depicted in FIG. 1 when positioned in its massage table configuration.

As perhaps best understood in connection with FIG. 6, a gradually declining cut 30, 32 is formed in the top edge of each sidewall 16, 18, respectively; each cut begins at the foot end of the chair and extends almost to the head end thereof as depicted. A sharply declining cut 34, 36 is formed in the top edge of each sidewall 16, 18, respectively, as well; each sharply declining cut extends a short distance from the head end of the combination device toward the foot end thereof, and meets its associated cut 30, 32, as shown.

Gradually declining cuts 30, 32 support seat member 38 at its opposite longitudinally extending edges, and sharply declining cuts 34, 36 support the lower end of seat back member 40 at its opposite longitudinally extending edges.

A first hinge means 42 (see FIG. 7) interconnects seat 38 and seat back 40; hinge means 42 includes removable pins 44 to facilitate disassembly of the novel apparatus so that it can be stored or shipped in a disassembled configuration. A second hinge means 46 (FIG. 6) at the top edge of rear wall 14 interconnects a back surface of the seat back 40 to said top edge of rear wall 14; it also has a removable hinge pin 48 to facilitate disassembly of the device.

As best shown in FIG. 7, a square tube 50, 52, is secured to and extends perpendicularly from a trailing end of each arm rest 54, 56. A complementally formed square tube 58, 60 having an interior diameter slightly larger than the exterior diameter of square tubes 50, 52 is received within an associated complementally formed opening formed in opposite sides walls of seat back 40. Thus, square tubes 58, 60 slidably receive square tubes 50, 52 so that arm rests 54, 56 are releasably attachable to the opposite side walls of seat back 40. The orientation of the square tubes 58, 60 disposes the arm rests in a horizontal plane and the square shape of the tubes prevents rotation thereof.

Another tube 62, 64, which may be formed integrally with tubes 58, 60, respectively as depicted, is positioned inside each arm rest 54, 56 in alignment with the longitudinal axis thereof. Tubes 62, 64 telescopically and selectively receive complementally formed tubes 63, 65 which are in turn pivotally mounted in supporting relation to a desk or tray member 68, 69. In this way, a left-handed person may releasably attach tray 69 to arm rest 56 and a right-handed person may releasably attach tray 68 to arm rest 54. Pivotal means 51, 53 enables the user to swing the tray in use out of the way when desired. As may be gleaned from FIG. 7, an exercise item including a spring or bungee cord and a handle may also be releasably and telescopically attached to each arm rest tube 62, 64.

Tubes 70, 72 are mounted within seat back 40 as shown in most of the Figures., just upwardly of the earlier-mentioned square tubes 58, 60, respectively. Said tubes telescopically and releasably receive tubes 74, 76, (FIG. 7) respectively, so that said tubes 74, 76 extend laterally with respect to the longitudinal axis of the seat/table 10. Tubes 74, 76 serve as the mounting means for another pair of springs, bungee cords, or other suitable bias means 78, 80, which are releasably attachable to the respective free ends of said tubes 74, 76. The outer ends of tubes 70, 72 are covered with finely crafted flexible flaps that hide them from view when not in use.

Reading light 82 having a flexible neck 84 surmounts seat back 40 as shown and performs the function its name expresses; note it is detachably received within square tube 83 which is positioned within seat back 40.

As shown in the Figs., support post 86 is hingedly mounted to and hangs freely from the back surface of seat back 40 when the novel apparatus is in its chair configuration. When novel apparatus 10 is transformed from its chair-providing configuration into its massage table-providing configuration, (FIG. 6), i.e., as seat back 40 is rotated rearwardly about hinge pin 48, support post 86 rotates about its hinge pin 87 and maintains its vertical orientation under the influence of gravity. It then supports seat back 40 when the massage table configuration is achieved. Although only one centrally mounted support post 86 is depicted, a pair of support posts at opposite sides of seat back 40 is within the scope of this invention, as are other obvious variations of this aspect of the invention. For example, instead of hanging freely in a vertical plane when the novel assembly is in its chaise lounge configuration, support post 86 could be snapped into a recessed channel formed in the back of the seat back, or stored in such hidden position by any other suitable means.

Seat 40 is also supported by one or more posts when in its massage table-providing configuration, as shown in FIG. 6. Support post 88 is positioned within the hollow interior of pedestal 11 and is connected to handle 90 which is positioned exterior to said pedestal by a suitable rod that extends through an opening formed in side wall 16. Thus, manual rotation of handle 90 imparts simultaneous and corresponding rotation to support post 88 to deploy said support post 88 into its seat-supporting configuration. The same apparatus could be provided at the opposite side of apparatus 10 as well. When returning the apparatus to its seat configuration, handle 90 is rotated to return support post 88 to its horizontal, storage configuration (shown in FIG. 3). Seat 40 is then pressed downwardly at hinge means 42, and seat back 40 is rotated back into its substantially upright configuration. The transformation consumes no appreciable amount of time.

Resilient strap 94 (FIG. 1) removably encircles the seat part of the apparatus near the foot end thereof and serves to hold down the feet of an exerciser performing sit-ups or other calisthentics.

A removable head or foot rest 96, shown in FIG. 7, is telescopically receivable within square tube 37 as shown. It includes square tube 98 and a suitable mechanism 97 for raising and lowering cushion 96 so that it may be adjusted to the comfort of the user.

One or more exercisers may use the apparatus simultaneously. They may lay face down or face up on the massage table and perform many different exercise activities. Since rear wall 14 is higher than front wall 16, the exerciser may elevate his or her head or feet as desired when lying supine upon the apparatus in its table configuration. An exerciser may sit at the end of the seat when the apparatus is configured as a seat, or may sit fully back therewithin, depending upon which bias means are being used. An exerciser may lie on his or her back on the seat part of the apparatus, with his or her legs supported by seat back 40. Other positions are attainable as well, and the various bias means may be employed from any number of positions.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A combination chaise lounge and massage table apparatus having receptacles for the attachment of exercise devices, comprising:

a hollow pedestal;

said hollow pedestal having a front wall, a back wall, and a pair of sidewalls disposed in interconnecting relation to opposite edges of said front and back walls;

each sidewall of said pair of sidewalls having a top edge and each top edge having a first part that is inclined gradually downwardly from said front wall toward said back wall and a second part that is inclined sharply downwardly from said back wall toward said front wall, said first and second parts meeting near said back wall;

a seat supported at its opposite longitudinal edges by said first part of said sidewall top edges;

a seat back supported at its opposite longitudinal edges by said second part of said sidewall top edges;

a first hinge for interconnecting said seat and said seat back;

a second hinge for interconnecting said seat back and a top edge of said back wall;

a first rotatably mounted support member for supporting said seat when said apparatus is in its table configuration;

a second rotatably mounted support member for supporting said seat back when said apparatus is in its table configuration; and said seat and seat back being disposed in a common plane when said apparatus is in its table configuration.

2. The apparatus of claim 1, further comprising an elongate bias means removably mounted to said seat at a forward edge thereof.

3. The apparatus of claim 1, wherein said first rotatably mounted support member is mounted within said hollow interior of said pedestal and wherein a handle member mounted exteriorly of said hollow interior controls the instantaneous position of said first rotatably mounted support member.

4. The apparatus of claim 1, wherein said second rotatably mounted support member depends from a back side of said seat back and is maintained in a substantially vertical plane by gravity when said seat back is in a chair configuration and when said seat back is in a massage table configuration, said second rotatably mounted support member hanging freely when said seat back is in its chair configuration and abutting a support surface when said seat back is in its massage table configuration.

5. The apparatus of claim 1, wherein said sidewalls are inclined slightly toward one another so that their respective upper edges are spaced closer together than their respective lower edges.

6. The apparatus of claim 1, further comprising a rectangular bottom wall having its peripheral edges fixedly secured to lowermost edges of said front wall, said rear wall, and said sidewalls.

7. The apparatus of claim 1, wherein said rear wall has a height greater than the height of said front wall so that said apparatus includes a table top that is inclined from the horizontal when the apparatus is in its massage table configuration.

8. The apparatus of claim 1, further comprising:

an access opening formed in said front wall so that exercise accessories may be stored in and retrieved from said hollow interior of said pedestal.

9. The apparatus of claim 8, further comprising:

an access opening formed in said rear wall so that exercise accessories may be stored in and retrieved from said hollow interior of said pedestal.

10. The apparatus of claim 8, further comprising a pair of elongate bias means, each elongate bias means of said pair of elongate bias means having a proximal end removably mounted in the hollow interior of said pedestal and having a distal end that terminates in a handle, each of said elongate bias means extending forwardly with respect to said front wall and each of said elongate bias means extending through said access opening.

11. The apparatus of claim 10, further comprising a pair of elongate rods removably mounted to opposite sides of said seat back, said elongate rods extending laterally with respect to said seat back.

12. The apparatus of claim 11, further comprising a pair of elongate bias means, each bias means of said pair of bias means having a proximal end removably secured to a free end of an associated elongate rod and having a distal end that terminates in a handle.

13. The apparatus of claim 1, further comprising a pair of arm rests removably mounted to opposite sides of said seat back.

14. The apparatus of claim 13, further comprising a tray pivotally mounted to a free end of a preselected arm rest of said pair of arm rests.

15. The apparatus of claim 13, further comprising:

a square bore formed in each side of said seat back;

a square tube being positioned within each of said square bores;

a square tube secured to each of said arm rests;

each of said square tubes secured to said arm rests being secured to its associated arm rest in perpendicular relation to a longitudinal axis of symmetry of said associated arm rest;

said square tubes associated with said arm rests being slidably disposed within said square tubes associated with said square bores so that said arm rests are removable;

said square tubes associated with said square bores being oriented to maintain said arm rests in a substantially horizontal plane when said arm rests are installed by sliding said arm rest square tubes into said bore square tubes.

* * * * *